United States Patent [19]

Bouthors et al.

[11] 4,415,313

[45] Nov. 15, 1983

[54] HYDRAULIC GENERATOR WITH FREE-PISTON ENGINE

[75] Inventors: Pierre Bouthors, Croissy sur Seine; Olivier Breting, Cormeilles en Parisis, both of France

[73] Assignee: Regie Nationale des Usines Renault, Boulogne-Billancourt, France

[21] Appl. No.: 290,319

[22] Filed: Aug. 5, 1981

[30] Foreign Application Priority Data

Aug. 5, 1980 [FR] France ..... 80 17288

[51] Int. Cl.[3] ..... F04B 17/00

[52] U.S. Cl. ..... 417/38; 417/214; 417/364

[58] Field of Search ..... 417/380, 364, 38, 11, 417/214, 340, 341, 342; 60/595, 596, 418, 406; 123/46 R

[56] References Cited

U.S. PATENT DOCUMENTS

| | | | |
|---|---|---|---|
| 2,472,934 | 6/1949 | Beale | 60/595 |
| 2,943,610 | 7/1960 | Foster | 60/595 X |
| 3,046,958 | 7/1962 | Bard et al. | 417/364 X |
| 3,606,591 | 9/1971 | Potma | 417/364 |
| 3,722,481 | 3/1973 | Braun | 60/596 X |
| 4,205,638 | 6/1980 | Vlacancinch | 417/380 X |
| 4,326,380 | 4/1982 | Rittmaster | 417/380 X |

*Primary Examiner*—Leonard E. Smith

*Attorney, Agent, or Firm*—Oblon, Fisher, Spivak, McClelland & Maier

[57] ABSTRACT

A hydraulic generator with a free-piston engine and hydropneumatic return cushion and with an associated hydraulic-fluid pumping piston feeding a hydraulic accumulator intended to be charged between two detected levels of pressure. The generator includes a lock device for the free piston at the power-stroke dead center with voluntary control, and servo-control means for this lock device with means for detection of the aforementioned two pressure levels, to assure locking the piston in response to detection of the aforementioned highest pressure level and to assure its unlocking in response to detection of the aforementioned lowest pressure level, and thus an automatic intermittent running of said engine.

17 Claims, 4 Drawing Figures

3
86
85
82
90
89
93
83
87
88
79
78
84
80
81
94
92
91

HYDRAULIC GENERATOR WITH FREE-PISTON ENGINE

BACKGROUND OF THE INVENTION

The invention relates to a hydraulic pressure generator with a free-piston engine with hydropneumatic return cushion and an associated hydraulic-fluid pumping piston feeding a hydraulic accumulator.

Aside from its proper use as a generator of hydraulic power in drive-power facilities used in this form, it is obvious that such a generator also makes it possible in particular to form a power unit for a hydrostatic-transmission vehicle with inertial power recovery in the accumulator.

SUMMARY OF THE INVENTION

The present invention is intended to permit a satisfactory and intermittent running of the free-piston engine to charge the accumulator, making it possible to obtain good, nonpolluting performance conditions.

Essentially, to this end the hydraulic generator according to the invention, for a free-piston engine with hydropneumatic return cushion and an associated hydraulic-fluid pumping piston feeding a hydraulic accumulator intended to be charged between two detected levels of pressure, includes a locking system for the free piston at the power-stroke dead center with voluntary control, and means for servo-control of this locking system by means of detection of the aforementioned two pressure levels to assure locking of the piston in response to detection of the aforementioned highest pressure level and to assure its unlocking in response to detection of the aforementioned lowest pressure level, and thus an automatic intermittent running of said engine.

Preferably, pumping is achieved by means of at least one differential piston, a first central part of which cooperates with the corresponding hydropneumatic return cushion which includes a hydraulic intake sealable by said first part of the differential piston after a certain power stroke of the free piston, and a chamber for pumping towards the accumulator is placed in the space of the ring part of the differential piston surrounding said central part and the hydropneumatic cushion, which makes it possible to obtain a greater initial acceleration of the free piston working against the cushion before pumping and to reduce heat loss through the walls at the start of the cycle.

In addition, the pump can be located in an intermediate portion of the free-piston stroke by putting the hydropneumatic cushion in communication with the pumping chamber in the final phase of the stroke of said differential piston, with an intercommunication passage provided for that purpose.

Preferably, the means for detecting the aforementioned lowest pressure level cooperate with the means for reconditioning the hydropneumatic cushion from the accumulator, and means are provided to defer the operation of the servo-control means for the locking or unlocking system after actuating said reconditioning means.

In order to dynamically balance the generator, the pump can be provided with two differential pistons consisting of weights having a symmetrical movement inverse to that of the free piston, these weights being hydraulically actuated by means of at least one transfer piston fixed to the free piston.

Rather than utilizing two transfer pistons for better synchronization of the weights, advantageous recourse may be had for this purpose to end-of-stroke stops for them.

As part of the aforementioned arrangement, the free piston may be cooled by means of an inertial piston placed in a cooling circuit fed by the movement-transmission or pump-circuit hydraulic fluid.

BRIEF DESCRIPTION OF THE DRAWINGS

Other particularities of the invention will also appear in the following description of two embodiments of a hydraulic generator according to the invention, given by way of example and with reference to the attached drawings, in which.

DETAILED DESCRIPTION OF THE PREFERRED EMBODIMENTS

Figures 1, 2:
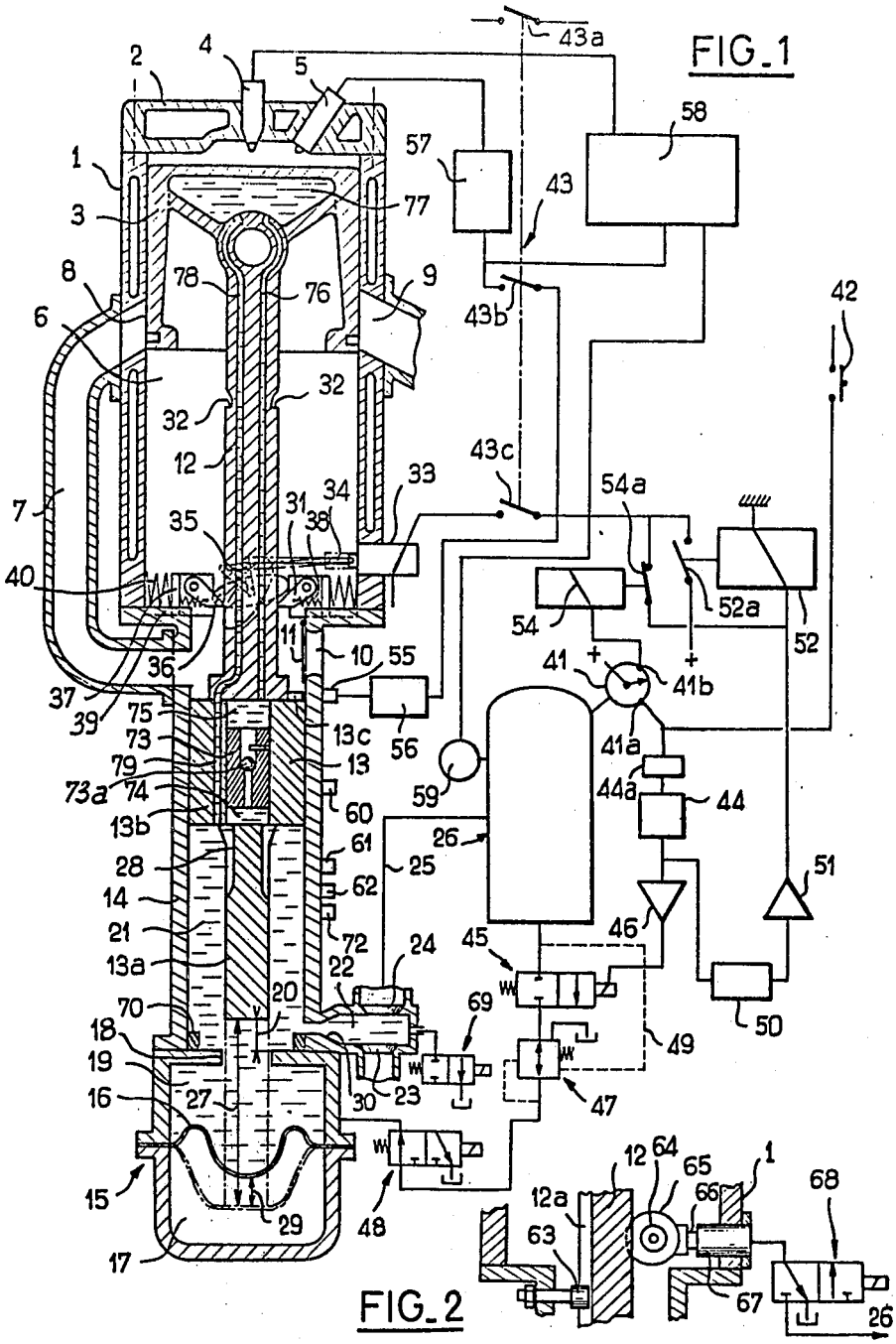
FIG. 1 is an elevated axial cross-section of one embodiment of a hydraulic generator according to the invention.
FIG. 2 is a detailed view of FIG. 1 in axial cross-section transverse to that in FIG. 1.

The hydraulic generator shown in FIG. 1 includes a one-cylinder engine with a free piston running in a two-stroke cycle, in which the crankcase has been designated by 1, the cylinder head by 2, the piston by 3, a fuel injector by 4, and a spark plug by 5.

The crankcase, as is known, constitutes a chamber 6 under the piston for the admission and compression of air for filling and sweeping out the cylinder, brought in by a manifold 7 having an intake slot 8 which, together with an exhaust slot 9, are uncovered by the piston 3 in the vicinity of its power-stroke bottom dead center, while an air admission slot 10 in the crankcase is provided with a one way valve 11.

The piston 3 is provided with a rod 12 passing through the crankcase, and which is fixed to a pump piston 13 sliding along the same axis as the free piston in a hydraulic-pump housing 14 extended by a hydropneumatic cushion 15, with a membrane 16 separating a volume of pressurized gas 17 from the hydraulic fluid present in the cushion and pump housing.

The pump piston 13 is a differential piston having a part **13*a* with a smaller diameter than its part 13*b* sliding in the housing 14, the part 13*a* being intended to slide into an intake 18 of the hydraulic chamber 19 of the hydropneumatic cushion after a certain extent of initial power stroke by the free piston indicated at 20**.

After this stroke 20, the part **13*b* of the differential piston acts as a back-flow piston for the hydraulic fluid present in the pumping chamber 21, then delimited between piston 13 and cushion, and which permanently communicates with a chamber 22 provided with at least one intake valve 23 and one back-flow valve 24. The intake valve 23 is placed on a pipe connected to the tank of the hydraulic circuit by a standard low-pressure force pump not shown. The back-flow valve 24 is connected by a pipe 25 to the hydraulic chamber of a hydraulic pressure accumulator schematically shown at 26. The maximum pressure in the cushion now being kept permanently below the minimum pressure in the accumulator, as will be seen further on, the result is that the phase of pumping towards the accumulator only begins after the initial power stroke 20 for pressurizing the cushion. In addition, the pumping phase is limited to an intermediate fraction of the total stroke 27 of the free piston, since the part 13***a* of the differential pumping piston has lateral passages 28 which in the final fraction 29 of the total stroke 27 place the hydropneumatic cushion once again in communication with the pumping chamber 21. The valve chamber 22 may also be given a divergent intake 30 for a reduction in the speed of the fluid pumped toward the valves in the actual pump stroke.

The free piston 3 can be locked at the power-stroke dead center, i.e., after the full stroke 27, by means of bolts 31 cooperating with corresponding notches 32 in the piston rod 12, and subjected to an electromagnetic control including an electromagnet 33, the moving contact of which is connected by small rods 34, 35 to a cam 36 governing the active or passive positioning of two slides 37 which carry the spring 38 and bolts 31, and which are mounted to dovetail with supports 39 provided in the crankcase. The slides are normally pushed into locking position by springs 40 when the electromagnet 33 is not excited.

Thus, such an engine is normally stopped in locked position at the power-stroke dead center by de-excitation of the electromagnet 33. It is intended to run intermittently under optimal or favorable conditions to charge the hydraulic accumulator 26 between two pressure values detected by a manometer 41 having an electrical contact 41*a* for detection of minimum pressure and an electrical contact 41*b* for detection of maximum pressure. Of course, it can also be started on demand when it is safely within the interval of these detected pressures.

An automatic start or restart control in response to detection of minimum pressure in the hydraulic accumulator 26 is illustrated in the example in FIG. 1, beginning with the contact 41*a* for detection of minimum pressure, parallel to which has been shown a pushbutton contact 42 to be actuated temporarily by the user for the possible aforementioned start on demand, after a switch 43 has been closed which has a contact 43*a* for general supply of voltage to the control circuits, a contact 43*b* for electrical supply of the starting circuit and the fuel-injection control which will be discussed further on, this switch 43 also authorizing possible excitation of the electromagnet by its contact 43*c*.

This starter control has a flip-flop, the lead-in to which is connected by a differentiator circuit 44*a* to the contact 41*a* and to the push-button contact 42. This flip-flop 44 responds to the rising edge of the signal transmitted by the closing of one or the other of these contacts, and its outlet then transmits a signal of predetermined length intended to cause an appropriate return to pressure in the hydropneumatic cushion 15 from the accumulator 26, prior to the unlocking of the free piston. This return to pressure of the cushion is provided for by means of an electromagnetic sluice gate 45 excited by means of an amplifier 46, fed with fluid by the accumulator 26 and attached to the lead-in of a reducing valve 47, the reduced-pressure outlet of which is connected by means of a normally open electromagnetic sluice gate 48 to the hydraulic chamber 19 of the cushion.

Preferably, the pressure valve 47 is of the reduced pressure type partially piloted according to the actual pressure in the accumulator 26 (introduced by the link 49) with a valve to relieve the reduced pressure in the tank in case of excess.

The starter control also has another flip-flop 50, the lead-in of which is connected to the outlet of the flip-flop 44 and which responds to the descending edge of the outlet signal from the latter (i.e., at the end of the cushion's 15 return to pressure) by a signal which is applied by means of an amplifier 51 to a self-supporting relay 52, the normally open contact 52*a* of which closes the excitation circuit of the electromagnet 33 governing the unlocking of the free piston when the relay is excited. This circuit furthermore includes the contact 43*c* of the switch 43, the opening of which makes it possible to voluntairly control the stop of the engine. This control therefore makes it possible to restart the stopped engine at the power-stroke dead center after recharging of the cushion 15 followed by the unlocking of the free piston, freed up for a compression phase, the start and suitable injection of fuel being provided to restart the engine in a single compression stroke of the free piston thus prepared and set off. Further on, other measures will be seen which can be taken to renew this restart process if need be.

When the running engine has charged the accumulator 26 to its maximum pressure detected by the manometer 41, the electrical contact 41*b* closes and causes the excitation of a relay 54, the normally closed contact 54*a* of which is placed in the self-supporing circuit of the relay 52, which it then opens so that the contact 52*a* reopens and the electromagnet 33 ceases to be excited, i.e., the locking of the free piston is then achieved at its first passage to the power-stroke dead center by the locks 31. The engine remains stopped in this position, even when the electrical contact 41*b* reopens following the pressure drop in the accumulator 26, the contact 54*a* reclosing and rearming the self-supporting circuit of the relay 52, so that a new start of the engine can be produced as explained above by the next closing of the contact 41*a* detecting the minimum pressure in the accumulator 26.

Ignition can be triggered by means of a position pick-up for the free piston or a part attached thereto, such as the pump piston 13, provided here with a magnet 13*c* with which in the vicinity of the top dead center cooperates a magnetic or inductive pick-up 55, which is external to the in-this-case nonmagnetic pump housing and connected by a working circuit 56 to a high-energy trigger device 57 with sparkplug 5.

The injector 4 may be of the electromagnetic type actuated by means of an electronic control 58 adapted to produce a command current triggered by the outlet signal from the working circuit 56, and having a variable duration regulating the amount of fuel injected according to storage in this control 58 of an injection law varying according to the pressure in the accumulator 26, this latter information being transmitted to it by means of a transducer 59 of analog or numerical type to adapt the amount of fuel injected to the pumping effort required, which varies with the actual pressure in the accumulator. Such an electronic regulation can easily be brought into play at each cycle, in the manner known. The injector could also be in particular a trigger injector piloted by the pick-up 55 and working circuit 56, and with direct hydraulic servo-control of the amount of fuel injected at the actual pressure in the accumulator 26.

In addition, regulation or stabilization of the free piston's stroke can be assured by monitoring of the latter used to introduce a complementary injection correction. To this end, three staged pick-ups 60, 61, 62 are provided here for stroke detection, cooperating with the magnet 13*c* carried by the pump piston, which in particular may be of the magnetic or inductive type. It will be noted in FIG. 2 that rectilinear guidance of the moving contact of the engine is assured here by means of a roller 63 the axis of which is attached to the crankcase and which cooperates with an axial groove 12*a* in the piston rod 12. The first 60 of the three aforementioned pick-ups is located so as to detect that there has been ignition of the fuel mixture but that the piston stroke is insufficient if it alone is actuated. The second 61 is located so as to detect that the stroke is sufficient, while the third 62 is located so as to detect whether the stroke is excessive in relation to that planned. Activation of the pick-up 60 can then be used alone to trigger an increase in the outlet signal from the electronic injection control, the joint activation of the pickups 60 and 61 cancelling out the preceding increase, while activation of the pick-up 62 will trigger a reduction in the outlet signal from the electronic injection control.

In addition, the absence of activation of the first pick-up 60 upon start or restart of the engine, which is the sign of a possible missed start, can be used to retrigger a start procedure, with a return to position of the free piston at the power-stroke dead center in a lock state.

To this end, means for return to position are here provided, including a friction pulley 64 intended to cooperate with the piston rod 12 and which is driven by a hydraulic engine 65 fed from the accumulator 26 and connected by a strap with the movable part 66 of a hydraulic jack 67 likewise actuated from the accumulator 26 by means of an electromagnetic sluice gate 68 common to the supply of the jack 67 and the engine 65.

To these drive means for returning the free piston to position are connected the electromagnetic sluice gate 48 intended to assure putting the hydraulic chamber 19 of the hydropneumatic cushion 15 on exhaust and an electromagnetic sluice gate 69, normally closed, attached to the pumping chamber 21 to assure that it is put on exhaust.

Triggering of this procedure is also used to de-excite the locking electromagnet 33, for example by cutting the self-supporting circuit of the relay 52 until the free piston is again locked.

This return to position of the free piston will therefore be achieved without having to overcome the hydraulic pressure normally opposing the pump piston, it being understood that after the return and relocking of the free piston at the power-stroke dead center which can be detected by the pick-up 62, the electromagnetic sluice gates 48, 68 and 69 are de-excited and a new start cycle can then be initiated, for example by a flip-flop acting in parallel to the flip-flop 44 on the amplifier 46 and the flip-flop 50.

Thus three successive start cycles can be considered before a breakdown signal is transmitted in case of failure.

In the highly unlikely case where the pumping should be cancelled out or appreciably reduced, for example by blockage in open position of a pump-chamber admission valve, absorption is provided at the end of the free piston's power stroke by cooperation of the pump piston 13 with an elastic end-of-stroke stop with nonlinear features.

This incident can then be signalled by abnormal stroke detection achieved by means of a supplementary pick-up 72 cooperating with the magnet 13*a* carried by the pump piston and serving to immediately actuate an engine-stop command, for example by means of a self-supporting cut-off relay not shown in FIG. 1 of the supply circuit of the control electromagnet 33 for locking the free piston.

Also provided for here is cooling of the free piston by means of the pump-circuit hydraulic fluid, with an inertial piston 73 in a cavity of the pump piston 13, this piston delimiting there on the one side a chamber 74 which communicates by the grooves 28 with the pump chamber 21 and on the other side a chamber 75 which communicates by a pipe 76 internal to the piston rod 12 with a cavity internal to the head of the piston 3, which communicates by another pipe 78 internal to the piston rod 12 with a pipe 79 in the pump piston which issues into the pump chamber 21.

The inertial piston 73 is here traversed at its axis by a channel having a non-return valve 73*a*. Thus, the running of the engine, through the play of the inertial movements relative to this piston 73, causes fluid to circulate between the cavity 77 in the head of the free piston and the pump chamber 21.

Figure 3:
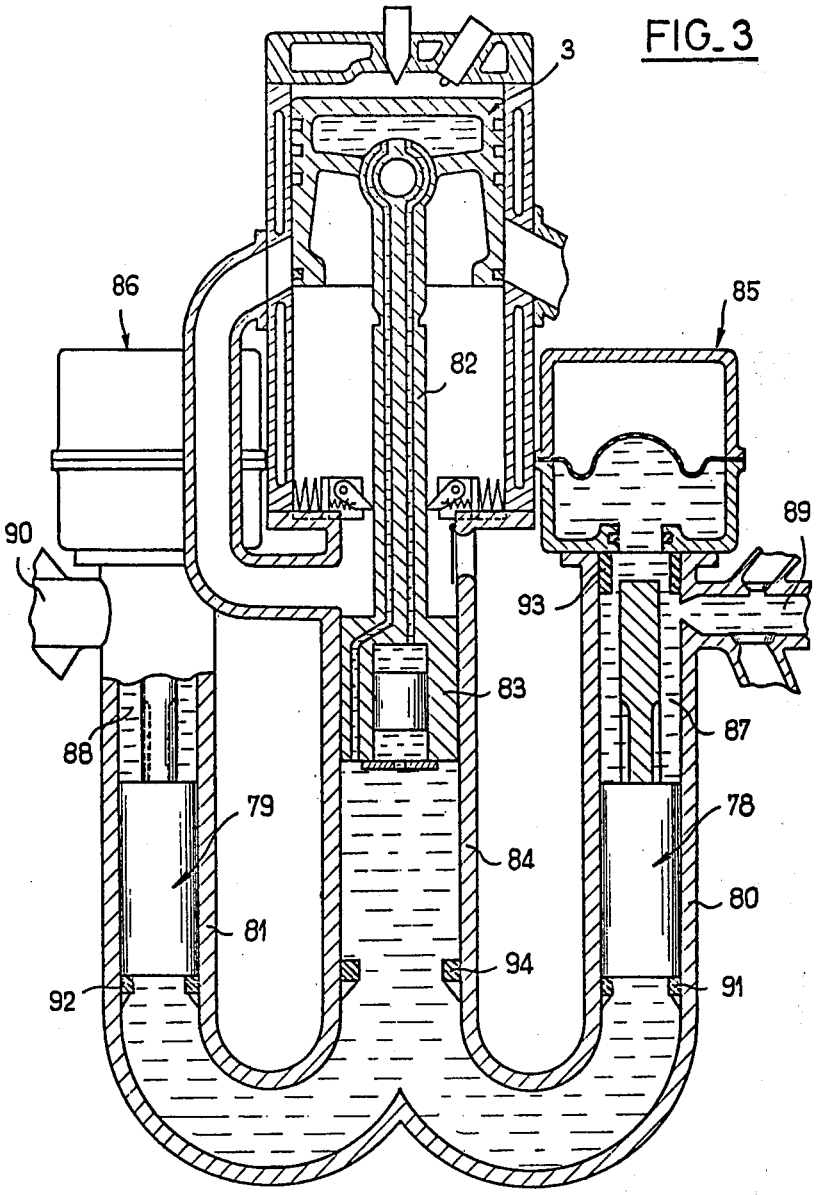
FIG. 3 is an analogous view of another embodiment of a hydraulic generator according to the invention.

FIG. 3 illustrates a variant according to which, in order to dynamically balance the entire generator, pumping is provided for by means of two differential pistons 78, 79 constituting two weights having symmetrical movement inverse to that of the free piston 3. These pistons are to this end arranged in two pump housings 80, 81, parallel and symmetrical in relation to the axis of translation of the free piston, the rod 82 of which carries a transfer piston 83 sliding in a cylinder 84 attached to the two pump housings and containing a hydraulic fluid transmitting pressure and movement between the transfer piston 83 and the differential pistons 78, 79 and vice-versa. Each differential piston 78, 79 cooperates with a hydropneumatic cushion 85, 86 with which it delimits a pump chamber 87, 88 communicating with a chamber having valves 89, 90, these last two feeding in parallel the hydraulic accumulator, not shown, of this generator.

In order to obtain good synchronization of the movements of the differential pistons 78, 79, end-of-return-stroke stops are provided for them at 91 and 92 in their respective pump housings 80, 81, as well as end-of-pump-stroke stops such as the stop 93, while one stop 94, the equivalent of the safety stop 70 in FIG. 1, is placed in the cylinder 84 of the transfer piston 83.

The engine's start and restart provisions are analogous to thos described in the case in FIG. 1, this time with common simultaneous control of the pressures in the two hydropneumatic cushions 85, 86 and chambers with valves 89, 90 as already explained, while a similar chain of control is provided for the locking device cooperating with the rod 82 of the free piston.

The pick-ups for triggering ignition, injection, and monitoring the stroke of the free piston can likewise be installed on the cylinder 84 and cooperate with the transfer piston 83 in the manner already explained for the pump piston in FIG. 1.

A restart procedure in case of misfire can also be implemented as already explained.

Figure 4:
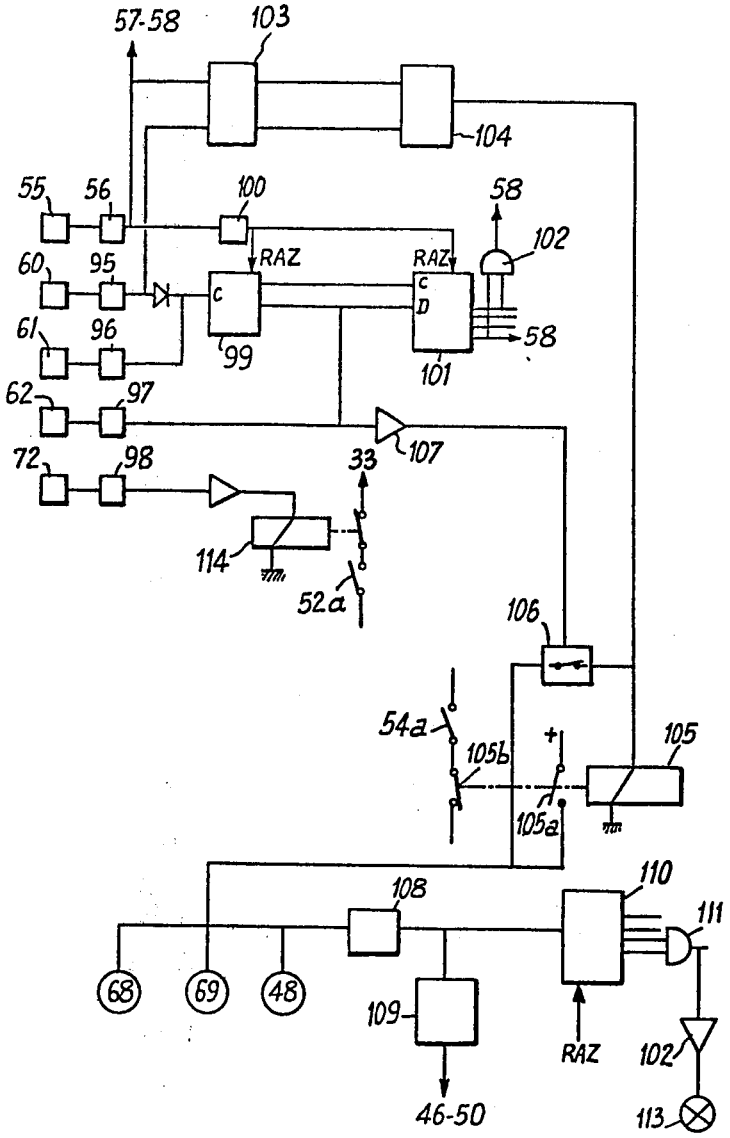
FIG. 4 is a diagrammatic view of a particular arrangement for controlling the running of a hydraulic generator according to the invention.

An example of means making it possible to assure in such embodiments the stroke-monitoring procedure governing regulation of injection, restart in case of misfire and the safety stop is illustrated in FIG. 4, where there is laid out in their order of installation the pick-ups 55, 60, 61, 62, and 72, followed by the working circuits 56, 95, 96, 97 and 98 respectively.

With regard to regulation of injection, the working circuit 95 of the signal of the pick-up 60 as well as the working circuit 96 of the signal of the pick-up 61 are connected to the counting lead-in of a binary counter 99, the reset-to-zero lead-in of which is connected to the outlet of the working circuit 56 of the signal of the pick-up 55 by means of a time-delay circuit 100, and the first two outlets of which are connected to the counting C and subtracting D lead-ins respectively of a binary counter-subtractor 101, the reset-to-zero lead-in of which is connected to the outlet of the time-delay circuit 100. The rank outlet 1 of the counter-subtractor 101 is connected to the electronic control 58, to which is also connected the outlet of an ET circuit 102, to the lead-ins of which are connected the rank outlets 1 and 4 of the counter-subtractor. The working circuit 97 of the signal of the pick-up 62 is likewise connected to the subtracting lead-in D of the counter-substractor 101.

Hence, according to the procedure already explained, by accepting that the aforementioned increases or reductions of the injection control 58 are taken into account at the triggering of the injection caused by the signal from the pick-up 55, while the resets to zero of the counter 99 and the counter-subtractor 101 are effected at the end of injection but before activation of the pick-up 60, it can be seen that, during the power stroke of the free piston:

1. when the pick-up 60 alone is actuated, the rank outlet 1 of the counter 99 and the rank 1 outlet of the counter-subtractor 101 go to the 1 state, which corresponds to an increase of the injection control 58 for the next injection;

2. when the pick-ups 60 and 61 alone are actuated, the signal from the pick-up 61 creates a logical 1 on the rank outlet 2 of the counter and therefore a subtraction in the counter-subtractor 101, the rank outlet 1 of which returns to zero, so that the next injection command will not undergo any incrementation (validation of the preceding incrementation can for this purpose be deferred in the control 58);

3. when the pick-up 62 is also actuated, the working circuit 97 transmits an impulse to the subtraction lead-in D of the counter-subtractor 101 which then goes to the binary state 1001 (decimal 9) detected by the ET circuit 102, the outlet of which going to the state 1 will correspond to a decrease of the injection control 58 (this impulse can be stored and locked into 58 until injection).

The restart procedure in case of misfire is detected by the absence of a signal from the pick-up 60 following that from the pick-up 55 within a given period of time, and to this end the outlets of the corresponding working circuits 56 and 95 are connected to the two lead-ins respectively of a flip-flop 103, the outlets of which are connected to the charge and discharge lead-ins respectively of the RC circuit of a delayed-action trigger 104, the outlet of which is connected to the coil of a relay 105 having a normally open contact **105*a*, a normally closed contact 105*b*, and a self-supporting circuit passing through a static switch 106 normally conducting and activatable by cut-off by means of an amplifying gate 107, the lead-in of which is connected to the outlet of the working circuit 97**.

It should already be understood that when the signal from the pick-up 55 is not followed by a signal from the pick-up 60, the delayed-action trigger 104 continues to be charged to be triggered by the flip-flop 103 (instead of undergoing a short charge cycle followed by a discharge cycle), and it then transmits an excitation signal to the self-supporting relay 105. The contact **105*a* of the latter is connected to the electromagnetic sluice gates 48 and 69 which then assure that the hydropneumatic cushion and pump chamber 21 are put on exhaust, and to the electromagnetic sluice gate 68 which feeds the jack 67 and the hydraulic motor 65 driving the pulley 64 cooperating with the piston rod 12 to bring the free piston back into end-of-power-stroke and lock position; it should be noted that the contact 105*b* when opened is placed in series with the contact 54*a* in the maintenance circuit of the relay 52, i.e., that it causes de-excitation of the latter and of the electromagnet 33 of the lock device, so that the bolts 31 are pushed into lock position of the free piston while awaiting for the notches 32** to pass before them.

The return of the free piston to the lock position is here detected by the signal from the excessive-stroke pick-up 62, which then triggers the cut-off of the switch 106 and hence that of the maintenance circuit of the relay 105, the contact **105*a* of which, as it reopens, de-excites the electromagnetic sluice gates 48, 68 and 69, and the contact 105*b* of which, reclosing, has no effect on the relay 52. In addition, the contact 105*a* is connected by means of an adaptation circuit 108 to the lead-in of a flip-flop 109 responding to the descending edge of the excitation signal from the electromagnetic sluice gates, and the outlet of which is connected to the lead-ins of the amplifier 46 and the flip-flop 50 so as to retrigger the start procedure already explained with the aid of FIG. 1** from the locked position of the free piston.

This restart procedure may for example be renewed three times before transmitting a breakdown signal as has been said, and a binary counter 110 is also provided, the counting lead-in of which is connected to the outlet of the adaptation circuit 108 and the rank outlets 1 and 2 of which are connected to an ET circuit 111, the outlet of which is connected by an amplifying gate 112 to a breakdown signal light 113.

Resetting the counter 110 to zero may result from an ordinary reinitialization circuit in the electrical components, taking place at each application of voltage to the electrical equipment of the vehicle achieved by the contact **43*a* of the switch 43**, while the aforementioned self-supporting relays are again placed at rest with each new voltage application.

Also shown in FIG. 4 are the means of the safety-stop procedure with activation of the pick-up 72, the working circuit 98 of which is connected to a self-supporting relay 114, normally closed, placed in the excitation circuit of the electromagnet 33 controlling piston lock, which it de-excites if there is an abnormal free-piston stroke in order to lock it by cooperation of the bolts 31 with the notches 32 of its rod 12, this safety stop also being the subject of a particular signalling not shown which may result from the closing of a second normally open contact of the relay 114.

Of course, various variants of control and implementation of such a hydraulic generator can be imagined, without thereby going beyond the scope of the invention.

What is claimed as new and desired to be secured by Letters Patent of the United States is:

1. A hydraulic pressure generator comprising:
an internal combustion engine having a cylinder and a free piston;
a hydraulic pump housing;
at least one hydraulic fluid pumping piston in said hydraulic pump housing and movable with said free piston, each said pumping piston having a reduced diameter portion;
hydraulic fluid in a pumping chamber of said housing defined by said pumping piston for being pumped by movement of said pumping piston;
a hydropneumatic return cushion in fluid communication with said chamber of said housing via an aperture, wherein said reduced diameter portion of said pumping piston closes said aperture during the stroke of said free piston;
means for locking said free piston in a bottom dead center position;
control means for controlling said means for locking;
a hydraulic accumulator in fluid communication with said fluid in said chamber of said housing;
sensor means for detecting the fluid pressure in said accumulator; and
manual means for actuating said means for locking,
wherein said control means is operative to actuate said means for locking when said sensor means detect a first high pressure, and operative to deactuate said means for locking when said sensor means detect a second low pressure.

2. The hydraulic generator according to claim 1 wherein said pumping chamber communicates with a chamber having admission and backflow valves by means of a divergent passage.

3. The hydraulic generator according to claim 1 including three pick-ups for detecting the free piston's end of power stroke, said three pick-ups including a first detector of a insufficient stroke, cooperating with means for increasing fuel injection when actuated, said first and a second detector being joint normal-stroke detectors, and a third detector, detecting an excessive stroke, said third detector cooperating with means for reducing fuel injection.

4. The hydraulic pressure generator according to claim 1 wherein said reduced diameter portion of said pumping piston has at least one passage, whereby during a final fraction of the power-stroke of the free-piston the cushion is placed in hydraulic communication with said pumping chamber.

5. Hydraulic generator with a free-piston engine according to claims 1 or 4 wherein said sensor means cooperate with means for refilling the hydropneumatic cushion with fluid from the accumulator, and wherein means are provided for delaying activation of said control means after activation of said refilling means.

6. The hydraulic generator according to claim 1 wherein said free-piston locking device consists of spring bolts cooperating with detents provided on said piston rod, said bolts being borne by slides subject to means for controlling approach and separation of said slides in relation to the piston rod.

7. The hydraulic generator according to claim 6 wherein said means for control of separation or approach include a cam equipped with an electromagnet, the de-excitation of which corresponds to the locked state of said locking means.

8. The hydraulic generator according to claim 1 including a pick-up for detecting the free piston's end of compression stroke, and means for triggering injection in response to said pick-up.

9. The hydraulic generator according to claim 8 wherein said injection-triggering means are controlled by a fluid pressure valve in the accumulator.

10. The hydraulic generator according to claim 1 wherein that said pumping piston is fixed to said free piston by means of a piston rod with which the locking means cooperates.

11. The hydraulic generator according to claim 10 wherein said pumping piston encloses an inertial piston placed in an internal cooling circuit of the free piston, said cooling circuit passing through the piston rod and communicating with said pumping chamber.

12. The hydraulic generator according to claim 10 including means for restarting the engine in case of misfire, said means for restarting including drive parts for selective engagement with said piston rod, said drive parts being activatable to bring back the free piston to the lock position at the power-stroke bottom dead center, and means for putting the hydropneumatic cushion and said pumping chamber on exhaust being connected to said means for restarting.

13. The hydraulic generator according to claim 1 wherein said at least one pumping piston comprises two pumping pistons constituting weights having a symmetrical movement inverse to that of the free piston, said weights being actuated hydraulically by means of at least one transfer piston fixed to said free piston by means of a piston rod with which the locking device cooperates.

14. The hydraulic generator according to claim 13 including end-of-stroke elastic stops provided for the weights.

15. The hydraulic generator according to one of the claims 13 or 14 wherein said transfer piston encloses an inertial piston placed in an internal cooling circuit of the free piston, said cooling circuit passing through the piston rod and communicating with the movement-transmission hydraulic fluid between the transfer piston and the weights.

16. The hydraulic generator according to claims 10 or 13, wherein said pumping piston cooperates with an elastic stop for absorption of abnormal end-of-stroke.

17. The hydraulic generator according to claim 16 including a pick-up for detection of abnormal stroke, said pick-up cooperating with means for triggering the locking device.

* * * * *